United States Patent [19]

Wayne et al.

[11] 4,182,946

[45] Jan. 8, 1980

[54] METHOD AND APPARATUS FOR ELIMINATING MICROWAVE LEAKAGE AT THE CONVEYOR PORTAL OF A MICROWAVE OVEN

[75] Inventors: I. R. Wayne; Bernard Krieger, both of Stamford, Conn.

[73] Assignee: Cober Electronics, Inc., Stamford, Conn.

[21] Appl. No.: 855,171

[22] Filed: Nov. 28, 1977

[51] Int. Cl.[2] ..... H05B 9/06

[52] U.S. Cl. ..... 219/10.55 A; 219/10.55 D; 219/10.55 F

[58] Field of Search ..... 219/10.55 A, 10.55 D, 219/10.55 F, 10.55 R

[56] References Cited

U.S. PATENT DOCUMENTS

| | | | |
|---|---|---|---|
| 3,151,230 | 9/1964 | Britton | 219/10.55 A |
| 3,239,643 | 3/1966 | Kluck | 219/10.55 D |
| 3,263,052 | 7/1966 | Jeppson et al. | 219/10.55 A |
| 3,885,118 | 5/1975 | Valtersson | 219/10.55 A |

*Primary Examiner*—Arthur T. Grimley
*Attorney, Agent, or Firm*—Bryan & Bollo

[57] ABSTRACT

A method and apparatus for preventing microwave leakage at a conveyor ortal channel of a microwave oven where a product to be treated is moved therethrough on a conveyor means, including the steps of positioning partitions on the conveyor means which carries the materials to be heated through the portal channel, and providing spaced protrusions between the moving peripheral walls of the partitions and the portal channel walls, thereby preventing microwave leakage from the oven.

19 Claims, 5 Drawing Figures

METHOD AND APPARATUS FOR ELIMINATING MICROWAVE LEAKAGE AT THE CONVEYOR PORTAL OF A MICROWAVE OVEN

The present invention relates to microwave chokes and more specifically to a method and apparatus for eliminating microwave leakage at a portal of a microwave oven.

Microwave energy is utilized in microwave ovens to effect heating of materials placed within the oven chamber. In treating materials in a microwave oven it is often desirable to use the oven in a continuous mode. In such a mode it may be necessary to pass materials through the microwave oven on a conveyor or other conveying means to provide a constant stream of items. It is desirable for an efficient production unit to have a microwave oven continuously operating while such stream of production items flows through the oven. However, in such an arrangement there is substantial leakage of microwaves at the entrance and exit of the oven. This escaping energy is called "microwave leakage". High power microwave leakage is dangerous causing heating of people or materials positioned too near the source of such microwave emissions, creating a hazard to anyone exposed to it. A safe level may only be reliably maintained if substantially all of the microwave leakage is prevented. Therefore, microwave chokes have been employed at conveyor portals. However, these known choke techniques all suffer from one or more deficiencies when applied to a conveyor portal in that they are not usable in continuous microwave treatment, are not effective at the frequency of the potential microwave leakage, do not provide a high degree of attenuation and/or are not readily usable with a conveying system.

Known choke means for use at conveyor entrances include partitions placed along conveyor means and being passed through a channel, as shown in Britton, U.S. Pat. No. 3,151,230. The partitions passed through the channel in this manner serve as an electromagnetic short and attenuate microwaves incident to the partitions within the channel. However, such a system does not effectively prevent microwave leakage in the space between the edges of the partition and the channel wall.

A quarter-wave trap is disclosed in Fritz, U.S. Pat. No. 3,166,663. Such an apparatus requiring the complicated technique necessary for maintaining the platform in position as it is moving through the entrance and exit channel leaves substantial problems in obtaining effective choking.

In microwave treatment where only a thin web is to be passed through a slot in the oven wall, corrugated choke means have been utilized to attenuate microwave leakage which would otherwise escape through the slot in the microwave oven. The corrugated choke includes protrusions from the slot shaped surfaces creating a reactance causing attenuation of the microwaves. This technique and the theory of operation of a corrugated choke is disclosed in an article by A. L. VanKoughnett and J. G. Dunn, "Doubly Corrugated Chokes For Microwave Heating Systems" in *Journal of Microwave Power*, 8(1), 1973, page 101 hereby incorporated by reference. A benefit obtained from a corrugated or doubly corrugated choke is the attenuation of modes of oscillation other than the primary mode.

The attenuation of modes other than the primary mode is obtained by the placement of a series of protrusions along the surface encountered by microwaves propagated along the surface. Rather than interacting with two consecutive protrusions additional modes which interact with alternating protrusions are also attenuated.

It is an object of the present invention to provide a method and apparatus for substantially complete attenuation of microwaves in the area between a partition and a channel wall in a microwave choke at a conveyor port in a microwave oven.

It is a further object of the present invention to provide an apparatus for continuously moving large items through a microwave oven without dangerous microwave leakage.

It is a still further object of the invention to provide a safe, inexpensive and easily constructed choke for use in continuous microwave treatment of items placed on a conveying system for passage through a microwave oven.

Briefly, the apparatus and associated method of the present invention includes channel walls forming a channel positioned at a portal through the oven wall of a microwave oven, a conveying means for transporting items through the channel having partitions positioned on the conveying means so that at least one partition is within the channel and protrusions between the channel walls and the partitions peripheral walls to provide microwave choking of the region between the channel wall and the peripheral walls of the partition.

When a partition passes through the channel the large forward surface of the partition shorts microwaves incident this surface while microwaves which miss the partition and pass through the area between the partitions and the channel walls are attenuated by the interaction of the protrusions with the opposing walls. For attenuation to occur, at least two protrusions, when viewed in the direction of conveyor travel through the channel, must be overlaid by the peripheral walls of the partitions and the channel walls. The operation of the choke is such that when the ends of the protrusions are adjacent the opposing walls there is created a corrugated choke between the peripheral walls of the partition and the opposing walls of the channel. The length of the protrusions and the spacing between protrusions is essential to the effective operation of the choke at any given frequency. Varying the length and spacing of the protrusions will vary the frequency at which the choke will operate.

By maintaining at least one partition within the channel and allowing space between the partitions for the placement of items to be treated in the microwave oven continuous choking occurs and items may be passed seriatim through the oven without the necessity for turning the oven on and off, or opening and closing a series of doors while moving the conveying system in a stop and go mode.

By providing the novel arrangement of a corrugated choke surrounding the partition and utilizing the partition itself, superior choking is obtained over previously known chokes.

The present invention is illustrated in the accompanying drawings, in which.

Figure 1:
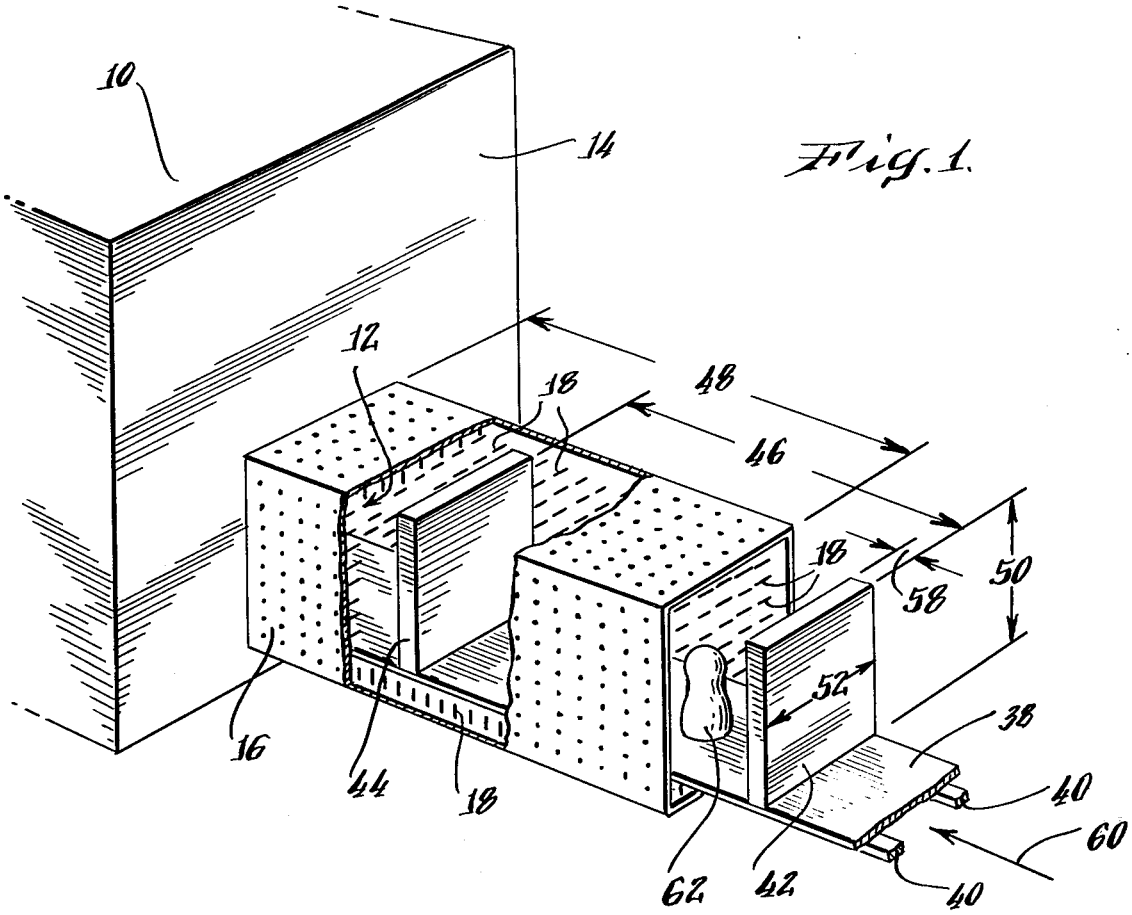
FIG. 1 is a perspective view, with parts broken away, of the present invention at a portal of a microwave oven.
Figure 2:
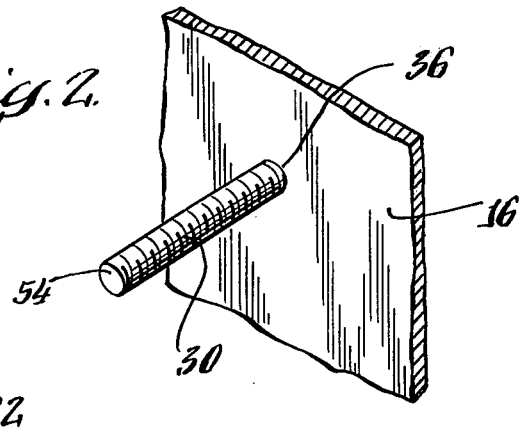
FIG. 2 is a blowup of a protrusion shown in FIG. 1.
Figure 3:
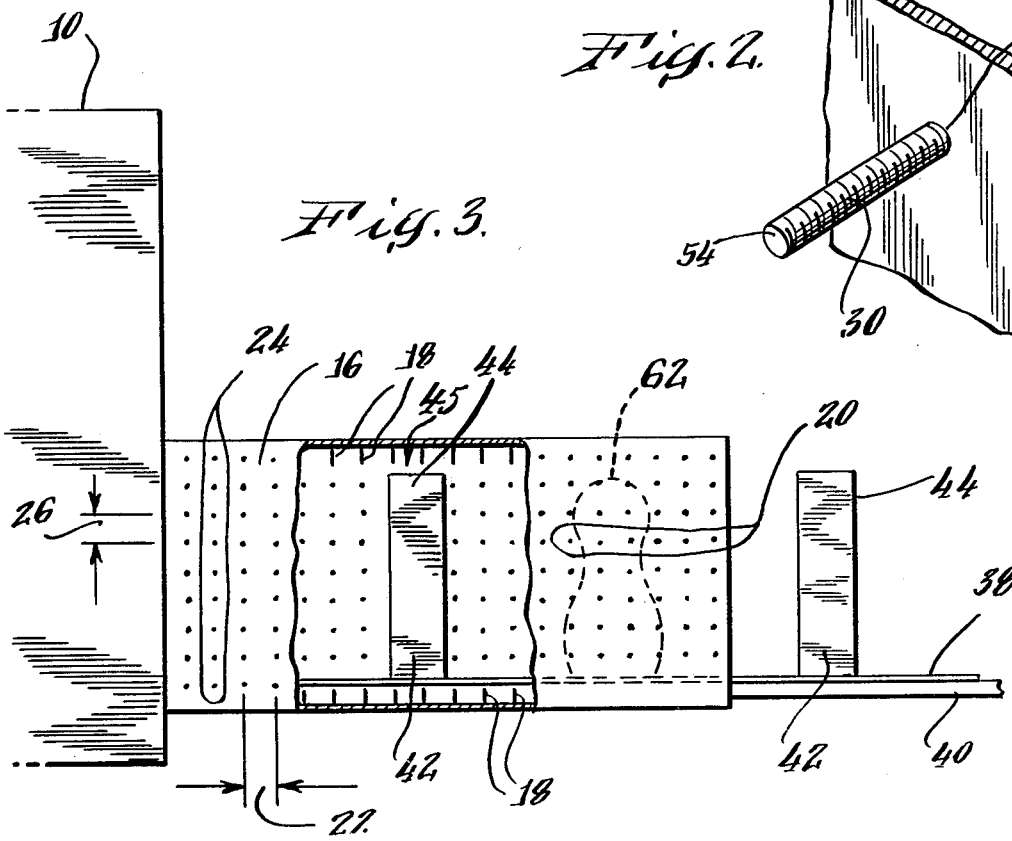
FIG. 3 is a side view, with parts broken away of the embodiment shown in FIG. 1.
Figure 4:
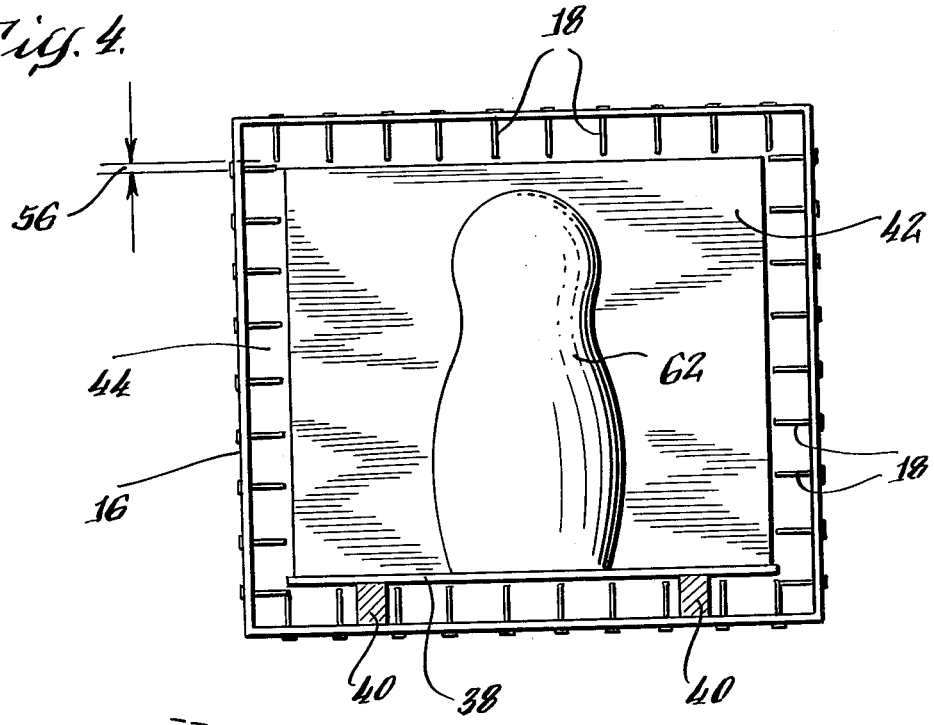
FIG. 4 is an end view of the embodiment shown in FIG. 1.

Referring to FIG. 1, a continuously operating microwave oven 10 is shown with an open portal 12 at one oven wall 14. Walls 16 of electrically conducting material are sealingly connected, as by soldering, to the oven wall 14 forming a channel therebetween. The sealed connection allows electrical conduction between the oven wall 14 and the channel walls 16. Affixed to the channel walls 16 are protrusions 18 of electrically conductive material which extend into the channel. The protrusions 18 are arranged in rows 20, see FIG. 3, with uniform spacing 22 between the protrusions 18 along the rows 20 and columns 24, where the protrusions 18 are separated along the columns 24 by a distance 26 equal to the spacing along the rows 22. For ease of adjustment, the protrusions 18 include threads 30, see FIG. 2, and have locking means, for example, a lock washer and nut to obtain and secure the proper length. The connections of the protrusions 18 to the channel walls 16 are electrically conducting.

The conveying means is shown here as a conveyor belt 38 which conveyor belt travels along, e.g., conveyor tracks 40 fastened in an electrically conducting manner to the channel bottom 16, and passes through the channel into the oven 10. Electrically conductive partitions 42 having peripheral walls 44 which are parallel to the channel walls 16 are positioned along the conveying means 38 separated by a distance 46 of less than the channel length 48 in order that at least one partition 42 is always within the channel. The height 50 and width 52 of the partitions 42 are such that the peripheral walls 44 of the partitions 42 are proximate the ends 54 of the protrusions 18 forming a corrugated choke 45. The distance 56 between the peripheral walls 44 and the ends 54 of the protrusions 18 is small to permit effective choke operation. The length 58 of the partitions 42 in the direction of conveyor travel 60 through the channel is sufficient to overlie at least two protrusions 18 in each column 24. Thus, the length 58 is at least twice the distance of spacing 26 between protrusions 18 in each column 24. The object to be treated 62 is placed on the conveying means 38 between partitions 42 and passed through the channel and into the oven 10.

Figure 5:
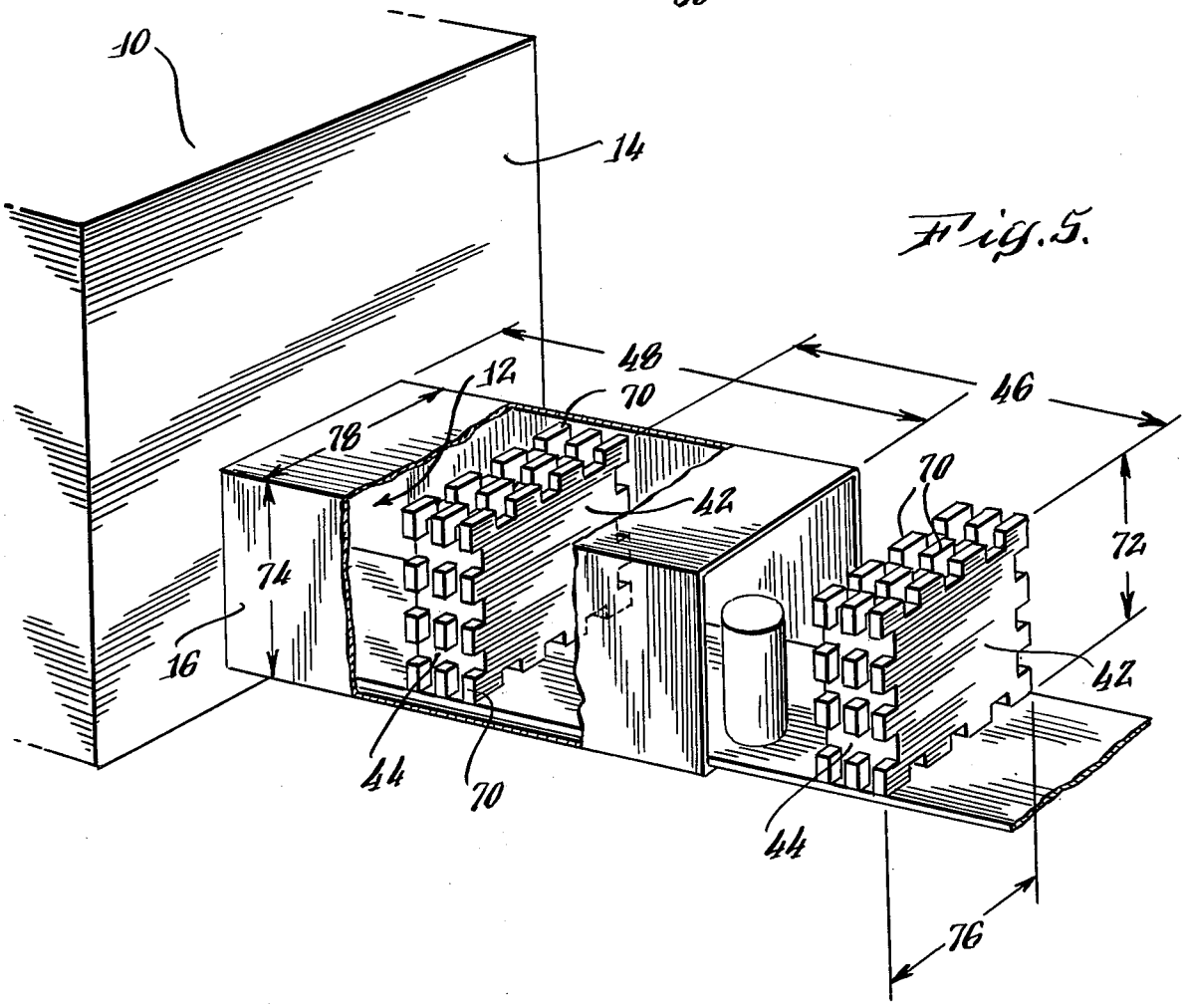
FIG. 5 is a perspective view, with parts broken away, of an alternative embodiment of the present invention at a portal of a microwave oven.

Referring to FIG. 5, a continuously operating microwave oven 10 is shown with a portal 12 at one oven wall 14. Walls 16 of electrically conducting material are sealingly connected to the oven wall 14 forming a channel. The sealed connection allows electrical conduction between the oven wall 14 and the channel walls 16. Conveying means 38 are provided and positioned for transporting items 62 through the channel and into the oven 10. Partitions 42 are placed along the conveying means 38 separated by a distance 46 of less than the channel length 48. Protrusions 70 extend from the peripheral walls 44 of the partitions 42. The peripheral walls 44 of the partitions 42 are parallel to the channel walls 16. The protrusions 70 here in the form of ridges, shown as raised portions of the peripheral walls 44, are arranged so that there are three protrusions 70 overlying each partition 42 in the direction of conveyor travel 60 through the channel. The protrusions 70 are electrically conductive and are sealingly connected to the peripheral walls 44 of the partitions 42. The partitions 42 are of electrically conducting material. The combined height 72 of the partition and attached protrusions is slightly less than the height 74 of the channel and the combined width 76 of the partition and attached protrusions is slightly less than the width 78 of the channel. Maintaining a small distance between the ends 80 of the protrusions 70 and the channel walls 16 is desirable to obtain effective choking.

In the exercise and practice of this invention, it is possible to utilize channel configurations other than those specifically identified above. For instance, this invention could be practiced with the channel having any shape which allows for the passage of a conveyor through the channel. It is not necessary that the conveyor pass along a channel wall and conveying means other than a conveyor belt are possible. Additionally,. it is not necessary that all protrusions be placed on the channel walls, or that all protrusions be placed on the partitions' peripheral walls. It is possible to place protrusions such that some channel wall surfaces have protrusions and some of the partitions peripheral surfaces have protrusions arranged along each of said surfaces so that the full circumference of the partition has protrusions. In a less efficient configuration protrusions could be provided upon only some of such surfaces without being provided between all such surfaces thus providing choking pursuant to this invention on only some surfaces of a partition.

The items 62 to be treated are placed on the conveyor means 38 between the partitions 42 for passage into the oven 10 after transportation through the channel.

What I claim is:

1. A choke for eliminating microwave leakage from a microwave oven, comprising:
   - a walled channel formed of electrically conducting material;
   - partitions suitable for passage through said walled channel;
   - means for transporting said partitions through said walled channel, said partitions being formed of electrically conducting material and having peripheral walls in the direction of travel through said walled channel parallel to the walls of said walled channel;
   - protrusions of electrically conducting material between the channel walls and the partitions' peripheral walls extending normally to the direction of conveyor travel through said channel, said protrusions having uniform length and spacing therebetween, the free end of each of said protrusions extending to a position adjacent their respective opposing wall;
   - said partitions having a length along their direction of travel through said channel to overlie at least two consecutive protrusions.

2. The choke claimed in claim 1 wherein said protrusions are ridges, said ridges being oriented perpendicular to the direction of travel of said partitions through said channel.

3. The choke claimed in claim 1 wherein the protrusions are posts arranged in rows and columns, said rows having posts separated by a distance equal to the distance between posts in said columns.

4. The choke claimed in claim 3 where the rows of posts are oriented perpendicular to the direction of travel of said partitions through said channel.

5. The choke claimed in claim 1 wherein said channel is rectangular and said partitions are rectangular said rectangular channel having posts protruding inwardly, said posts being of uniform length and arranged in rows and columns, said partitions being affixed to conveyor means for transporting said partitions through said channel, said partitions having peripheral walls proximate the ends of said posts and being of sufficient length, in the direction of partition travel through said channel, such that at least two posts in each column are adjacent said partitions during such time as said partitions are in said channel.

6. The choke claimed in claim 5 wherein said rows of protrusions are perpendicular to the direction of travel of said partitions through said channel.

7. The choke claimed in claim 1 wherein the protrusions protrude from the peripheral walls of each partition, said protrusions having ends proximate the walls of said channel during such time as each partition is in said channel.

8. The choke claimed in claim 1 wherein the protrusions protrude from said channel walls into said channel, said protrusions having ends proximate the peripheral walls of such partitions as are aligned with said protrusions.

9. The choke claimed in claim 1 where the protrusions are on the walls of said channel and the peripheral walls of each partition, the free ends of said protrusions from said channel proximate the free ends of said protrusions from such partitions being within said channel.

10. The choke claimed in claim 1 where said protrusions protrude from a portion of the walls of said channel, and a portion of the peripheral walls of said partitions such that said protrusions extend between the peripheral walls of such partitions being in said channel and said channel walls.

11. The choke claimed in claim 1 where said partitions are concentric with said channel during such time as said partitions are in said channel.

12. A choke for eliminating microwave leakage from a microwave oven, comprising;

electrically conducting walls forming a channel positioned at a portal to a microwave oven;

partitions suitable for passage through said channel;

means for transporting said partitions through said channel, said partitions being formed of electrically conducting material, said partitions having a dimension in the direction of conveyor travel through said channel sufficient for attenuation of waves by a corrugated choke operating in the area between said partitions and said channel;

corrugated choke means positioned so as to operate in the area between said channel walls and the peripheral walls of such partitions as are within said channel.

13. The choke claimed in claim 12 wherein the corrugated choke means are positioned on the wall of said channel, said partitions having peripheral walls parallel to the direction of travel of said partition through said channel, said peripheral walls being adjacent said corrugated choke means.

14. The choke claimed in claim 12 wherein said corrugated choke means are located on the peripheral walls of said partitions, the channel having conducting walls, said peripheral walls adjacent said channel walls.

15. The choke claimed in claim 12 wherein the corrugated choke means are positioned on the walls of said channel and the peripheral walls of said partitions, said peripheral walls of said partitions being adjacent said channel walls.

16. A choke for eliminating microwave leakage from a microwave oven, comprising;

a walled channel formed of electrically conducting material positioned at a portal to a microwave oven;

partitions suitable for passage through said channel;

means for transporting partitions through said channel; said partitions being formed of electrically conducting material and having peripheral walls with a dimension in the direction of travel through said channel sufficient for attenuation of microwaves by a corrugated choke.

protrusions of electrically conducting material extending normally from the channel walls into said channel, said protrusions being of adjustable length and having locking means to secure the length of said protrusions at a uniform length, the ends of said protrusions extending to a position adjacent the peripheral walls of the partitions, said protrusions being arranged in rows and columns having uniform spacing therebetween.

17. A method for preventing microwave leakage at a conveyor portal of a microwave oven, including the steps of positioning partitions having peripheral walls along conveyor means carrying the materials to be heated, positioning a walled channel at said portal, passing said partitions through said channel so that at least one partition is within said channel, providing protrusions between the peripheral walls of said partitions and the walls of said channel.

18. The method of claim 17 where the protrusions are positioned on the walls of said channel and are extended into the channel.

19. The method of claim 17 where the protrusions are positioned on the peripheral walls of said partitions so that two or more protrusions are provided in the direction of conveyor travel.

* * * * *